US006845850B1

(12) United States Patent
Schneck

(10) Patent No.: US 6,845,850 B1
(45) Date of Patent: Jan. 25, 2005

(54) BUTTON/SWITCH ARRANGEMENT FOR ELEVATOR CONTROL WHICH CHANGES THE EXTERNAL APPEARANCE OF THE BUTTONS AND BUTTON PANEL, WHILE STILL USING THE CONTROL BOARDS OF THE ELEVATOR CONTROL

(75) Inventor: Ernest W. Schneck, Rutherford, NJ (US)

(73) Assignee: Regency Elevator Products Corp., Newark, NJ (US)

( * ) Notice: Subject to any disclaimer, the term of this patent is extended or adjusted under 35 U.S.C. 154(b) by 175 days.

(21) Appl. No.: 10/353,486

(22) Filed: Jan. 29, 2003

(51) Int. Cl.[7] ..... B66B 1/52
(52) U.S. Cl. ..... 187/395; 187/247
(58) Field of Search ..... 187/395, 396, 187/414; 361/600, 602, 614, 622, 627, 633, 720, 736; 200/520, 530, 532

(56) References Cited

U.S. PATENT DOCUMENTS 4,193,478 A * 3/1980 Keller et al. ..... 187/247
4,490,775 A * 12/1984 Quan ..... 361/686
5,014,002 A * 5/1991 Wiscombe et al. ..... 324/537
5,313,026 A * 5/1994 Youla et al. ..... 187/399
5,739,777 A * 4/1998 Kaneko ..... 341/50
5,889,240 A * 3/1999 Purosto et al. ..... 187/395
6,029,778 A * 2/2000 Lacarte Estallo ..... 187/414
6,227,335 B1 * 5/2001 Koeppe et al. ..... 187/414
6,427,807 B1 * 8/2002 Henneau ..... 187/247

FOREIGN PATENT DOCUMENTS

EP 403232 A2 * 12/1990 ..... B66B/3/00

* cited by examiner

*Primary Examiner*—Jonathan Salata
(74) *Attorney, Agent, or Firm*—Richard M. Goldberg

(57) ABSTRACT

An elevator button/switch arrangement includes a face plate; nine buttons mounted to the face plate; a button actuation portion associated with each button and suppling an output signal when a respective button is actuated; a 4-pin connector connected with each button actuation portion; a COP interface board receiving the output signals from the pin connectors and supplying motor control signals to a motor to control movement of an elevator; and an interface board including a 40-pin connector connected with the 4-pin connectors, a 20-pin connector connected with the COP interface board, and wiring connected between the 40-pin connector and the 20-pin connector for reducing the number of output signals from the 36 active pins to a maximum of 20 output signals for supply to the COP interface board from the 20-pin connector.

9 Claims, 10 Drawing Sheets

BUTTON/SWITCH ARRANGEMENT FOR ELEVATOR CONTROL WHICH CHANGES THE EXTERNAL APPEARANCE OF THE BUTTONS AND BUTTON PANEL, WHILE STILL USING THE CONTROL BOARDS OF THE ELEVATOR CONTROL

BACKGROUND OF THE INVENTION

The present invention relates generally to elevators, and more particularly, is directed to a button/switch arrangement for an elevator control.

Otis Elevator Co. is a well known manufacturer of elevators. One of its more popular elevators has been sold as Model No. 401 under the trademark "ELEVONICS" for use in multi-story buildings. In this elevator, there is a front panel with buttons that the user presses in order to select a desired floor to which the elevator is to be moved. The buttons are fixed to nine-button boards which are mounted to a car operating panel known as a COP panel. Thus, if there are fifty-four floors in the building, there would be six nine-button boards, with the external facing buttons numbered one through fifty-four.

Nine-button flat ribbon interface cables connect each button to a COP interface board (Otis Part No. ABA26800ACA001) having pin connectors thereon through which the COP interface board is directly mounted to a COP II board (Otis Part No. AAA26800ACB001). The COP interface board has at least one 40-pin connector for receiving the ends of the flat ribbon interface cables. The COP II board interfaces with the motor control for the elevator in order to control movement of the elevator. Thus, when a person presses a button, a momentary contact switch is closed to supply a voltage signal through the COP interface board to the COP II board which latches onto the signal. When the button is released, the momentary contact switch is opened and the signal supply to the COP interface board and the COP II board is terminated. However, since the COP II board latches onto the signal, the command for the particular floor still remains.

In many instances, it is desirable to change the external look of the elevator buttons, for example, to provide a more regal look or the like. However, this is not practical with the Model 401 elevator without changing the entire operating system and all boards and panels, at an extensive cost. In other words, it is not possible to merely change the front panel, buttons and nine-button boards.

OBJECTS AND SUMMARY OF THE INVENTION

Accordingly, it is an object of the present invention to provide a button/switch arrangement for an elevator control that overcomes the problems with the aforementioned prior art.

It is another object of the present invention to provide a button/switch arrangement for an elevator control for the Otis Model 401 elevator in which the external appearance of the buttons and button panel can be readily changed at minimal cost.

It is still another object of the present invention to provide a button/switch arrangement for the Otis Model 401 elevator in which the external appearance of the buttons and button panel can be readily changed, while still using the basic COP interface board and COP II board of such system.

The present invention is directed to modification of a known elevator control arrangement for an Otis Elevator Model No. 401 elevator which includes a car operating panel (COP) housing nine-button boards with buttons numbered in correspondence with the floor numbers. Each nine-button board includes two 20-pin male connectors mounted to the rear surface thereof. The nine-button boards are electrically connected by nine-button interface cables to a car operating panel (COP) interface board, which includes three 40-pin male connectors and two 96-pin female connectors for direct connection to two 96-pin male connectors on a car operating panel (COP) II board, the latter interfacing with a motor control for the elevator in order to control movement of the elevator.

In order to chance the external look of the elevator buttons to provide a more regal look, the COP panel and nine-button boards are changed in order to present a different button display and face plate to the user, while leaving the COP interface board and COP II board intact.

Specifically, a button panel includes a face plate having a plurality of buttons, each having numeric indicia adjacent the respective buttons. An actuation portion of each button provided on the rear surface of the face plate, has a normally open switch and includes an 8-pin male connector for supplying an output signal from the switch which is closed when a button is depressed.

Two or more interface boards are mounted to the rear surface of the face plate. A 40-wire ribbon cable provides the electrical connection between 8-pin male connectors and the interface boards. Each interface board includes a 40-pin male connector and two 20-pin male connectors, and a 40-wire ribbon cable includes a 40-pin female connector at one end which is connected to the 40-pin male connector. The opposite end of the 40-wire ribbon cable is separated into nine 4-wire sets, each connected to four contacts of an 8-pin female connector that is connected to the respective 8-pin male connectors. In effect, the 8-pin female connector has only four active pins and is equivalent to a 4-pin female connector.

The 40-pin male connector is electrically connected through wiring on the interface board to a first 20-pin male connector and to a second 20-pin male connector, either of which is used to output the signals from actuation portions to the COP interface board. The first 20-pin male connector functions as an auxiliary input with a second button panel in the same elevator. This connection is made by the circuit wiring on the interface board in accordance with a particular chart.

Thus, the interface board transforms the signals of the thirty-six pins from each set of nine buttons from the nine 8-pin male connectors associated with each set of nine buttons to signals which can be output from the second 20-pin male connector, thereby providing the equivalent of the outputs from the prior art 20-pin male connectors. This is accomplished by ganging certain ones of the pins. In this manner, only the COP panel and nine-button boards of the prior art need be changed, without providing any chance to the remainder of the system, at a tremendous cost and time saving. Thus, the button/switch arrangement of an Otis Model 401 elevator can be easily updated and/or modified.

The above and other objects, features and advantages of the invention will become readily apparent from the following detailed description thereof which is to be read in connection with the accompanying drawings.

DETAILED DESCRIPTION

Figure 1:
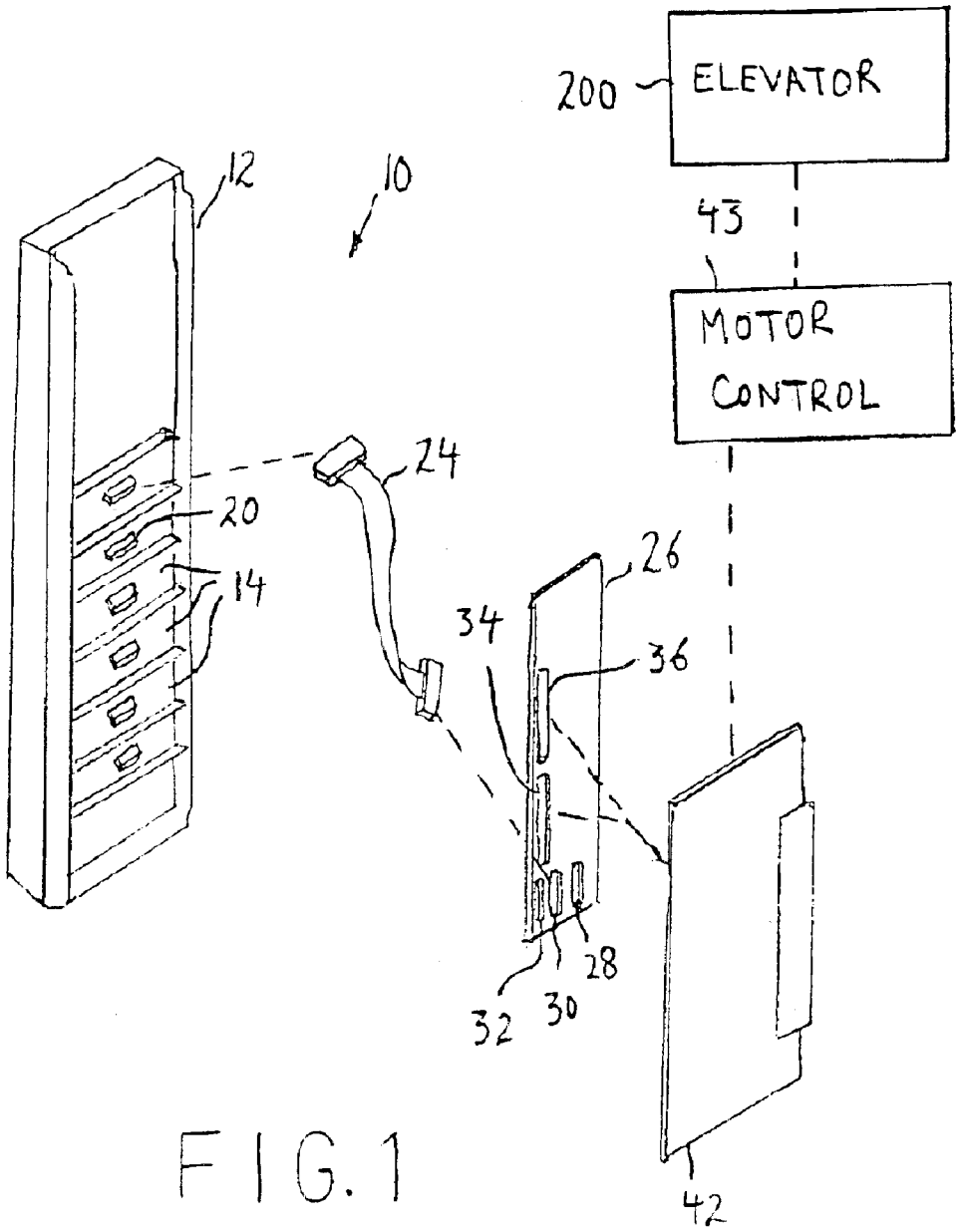
FIG. 1 PRIOR ART
FIG. 1 is a blown-apart perspective view of a known elevator control arrangement for an Otis Elevator Model No. 401 elevator.
Figure 2:
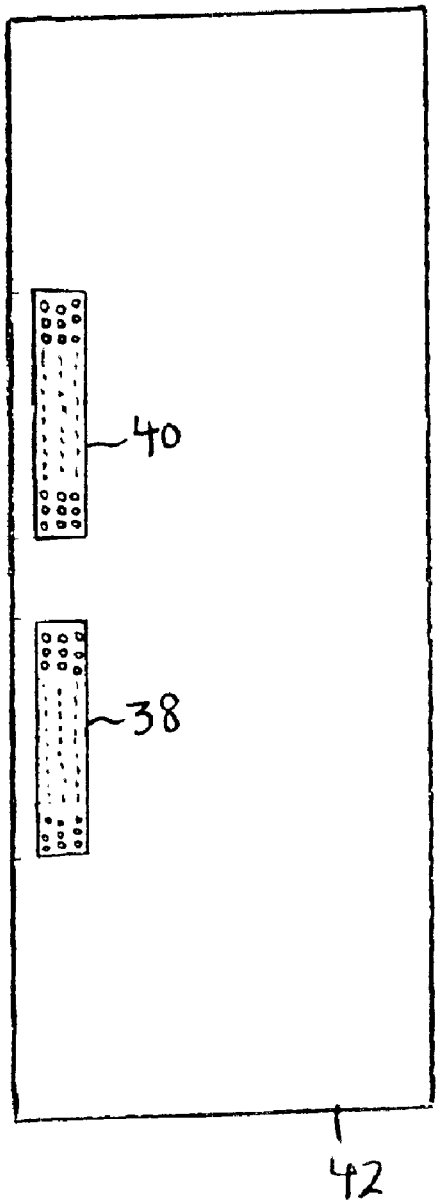
FIG. 2 PRIOR ART
FIG. 2 is a top plan view of the COP II board of the elevator control arrangement of FIG. 1.
Figure 3:
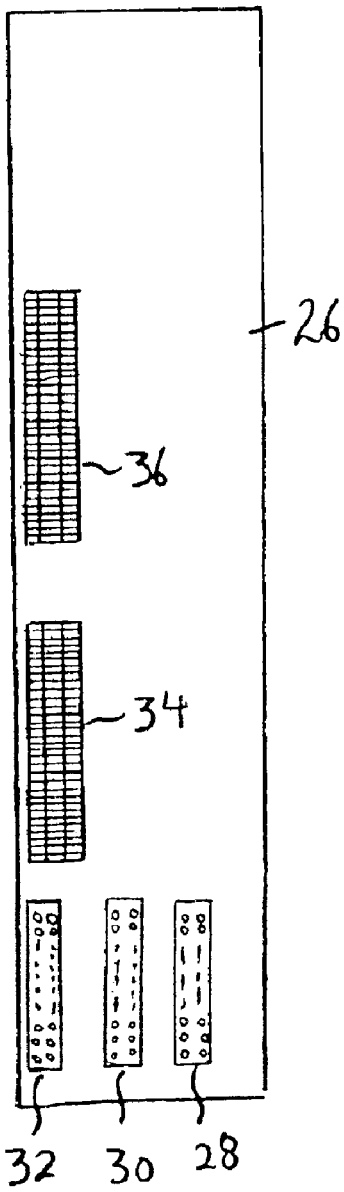
FIG. 3 PRIOR ART
FIG. 3 is a bottom plan view of the COP interface board of the elevator control arrangement of FIG. 1, which connects with the COP II board of FIG. 2.
Figure 4:
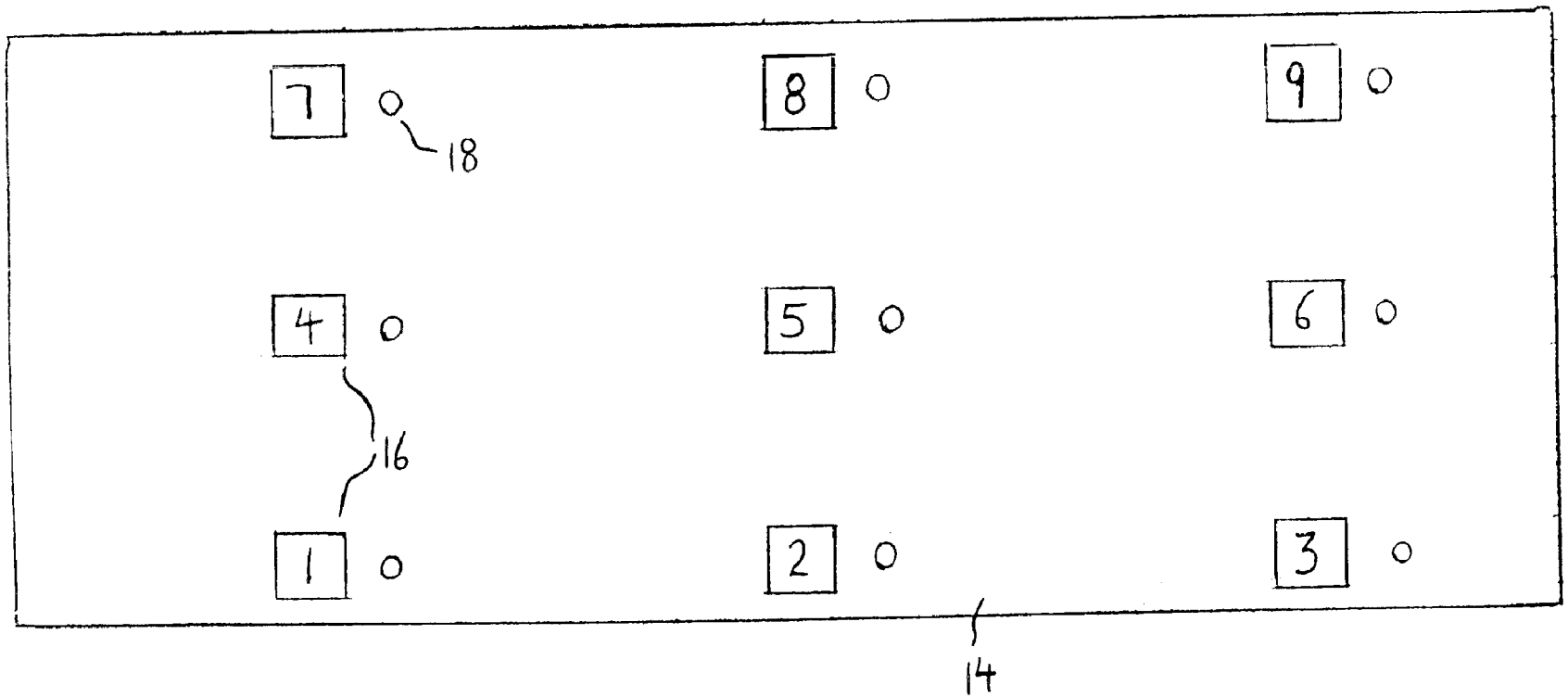
FIG. 4 PRIOR ART
FIG. 4 is a front elevational view of one of the nine-button boards which is mounted to the COP panel of the elevator control arrangement of FIG. 1.
Figure 5:
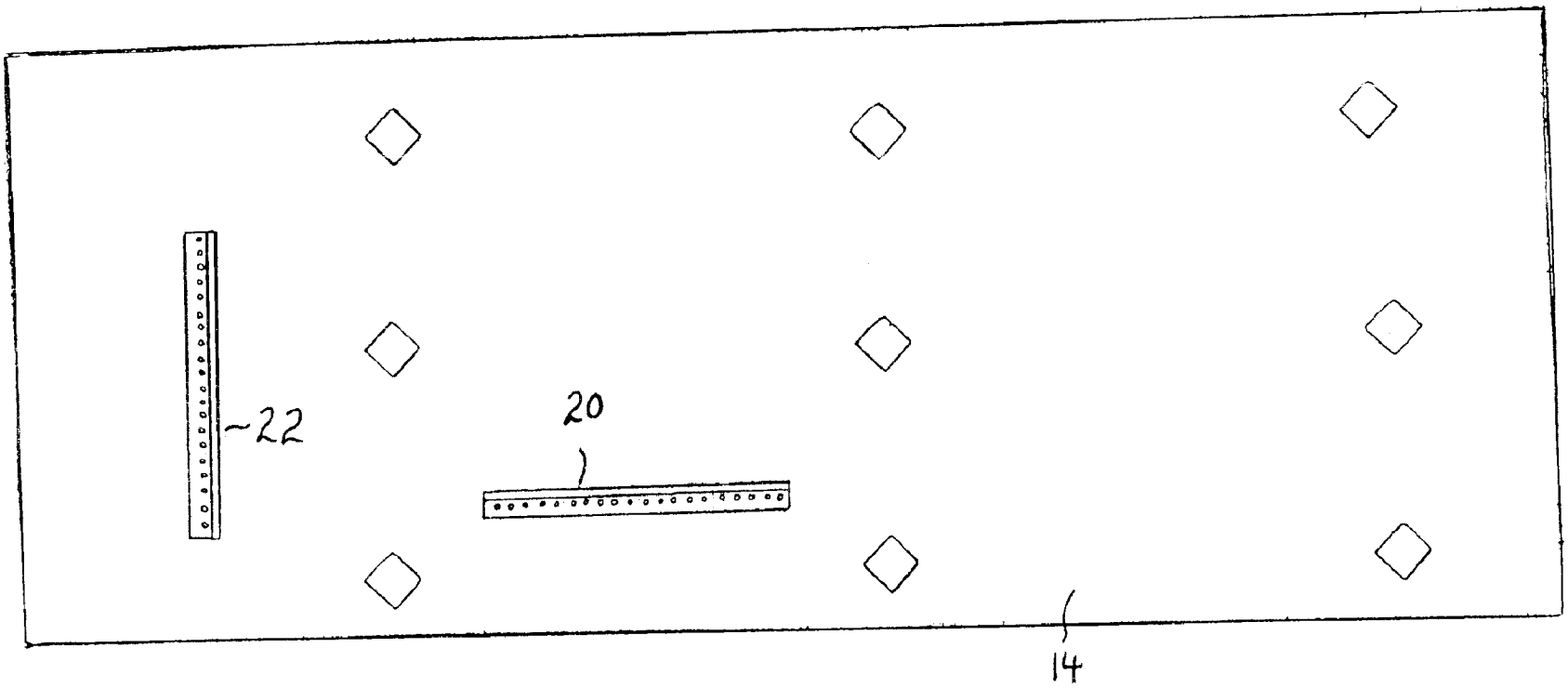
FIG. 5 PRIOR ART
FIG. 5 is a rear elevational view of the nine-button board of FIG. 4.

Referring to the drawings in detail, and initially to FIGS. 1–5, a known elevator control arrangement 10 for an Otis Elevator Model No. 401 elevator 200 includes a car operating panel 12, known as a COP panel, which houses various nine-button boards 14 therein. The front surfaces of nine-button boards 14 include buttons 16 which are numbered in correspondence with the floor numbers, for example, 1 through 9, 10 through 18, and so on. A light 18 is positioned adjacent each button to indicate whether the respective button 16 has been pushed. Each nine-button board 14 further includes two 20-pin male connectors 20 and 22 mounted to the rear surface thereof. Other circuitry and wiring connections on nine-button board 14 are omitted from the drawings for the sake of brevity.

Nine-button boards 14 are electrically connected by nine-button interface cables 24 to a car operating panel (COP) interface board 26. Only one nine-button interface cable 24 is shown in FIG. 1. Specifically, COP interface board 26 includes three 40-pin male connectors 28, 30 and 32, and ribbon cables 24 are connected between 20-pin male connectors 20 and 40-pin male connectors 28, 30 and 32. It will therefore be appreciated that six nine-button boards 14 corresponding to fifty-four floors can be connected to each COP interface board 26.

COP interface board 26 further includes two 96-pin female connectors 34 and 36 mounted thereon, for direct connection to two 96-pin male connectors 38 and 40 on a car operating panel (COP) II board 42.

Other circuitry and wiring connections on COP interface board 26 and COP II board 42 are omitted from the drawings for the sake of brevity.

COP II board 42 interfaces with motor control 43 for the elevator in order to control movement of the elevator. Thus, when a person presses a button 16, a momentary contact switch is closed to supply a voltage signal through COP interface board 26 to COP II board 42 which latches onto the signal. When the button 16 is released, the momentary contact switch is opened and the signal supply to COP interface board 26 and COP II board 42 is terminated. However, since COP II board 42 latches onto the signal, the command for the particular floor still remains.

In many instances, however, it is desirable to change the external look of the elevator buttons, for example, to provide a more regal look or the like. However, this is not practical with the Model 401 elevator without changing the entire operating system and all boards and panels, at an extensive cost and with extensive wiring. In other words, it is not possible to merely change COP panel 12, nine-button boards 14 and buttons 16.

The present invention is arranged to replace the COP panel 12 and nine-button boards 14 in order to present a different button display and face plate to the user, without changing additional circuitry, for example, while leaving COP interface board 26 and COP II board 42 intact, thereby substantially reducing the wiring and costs.

Figure 6:
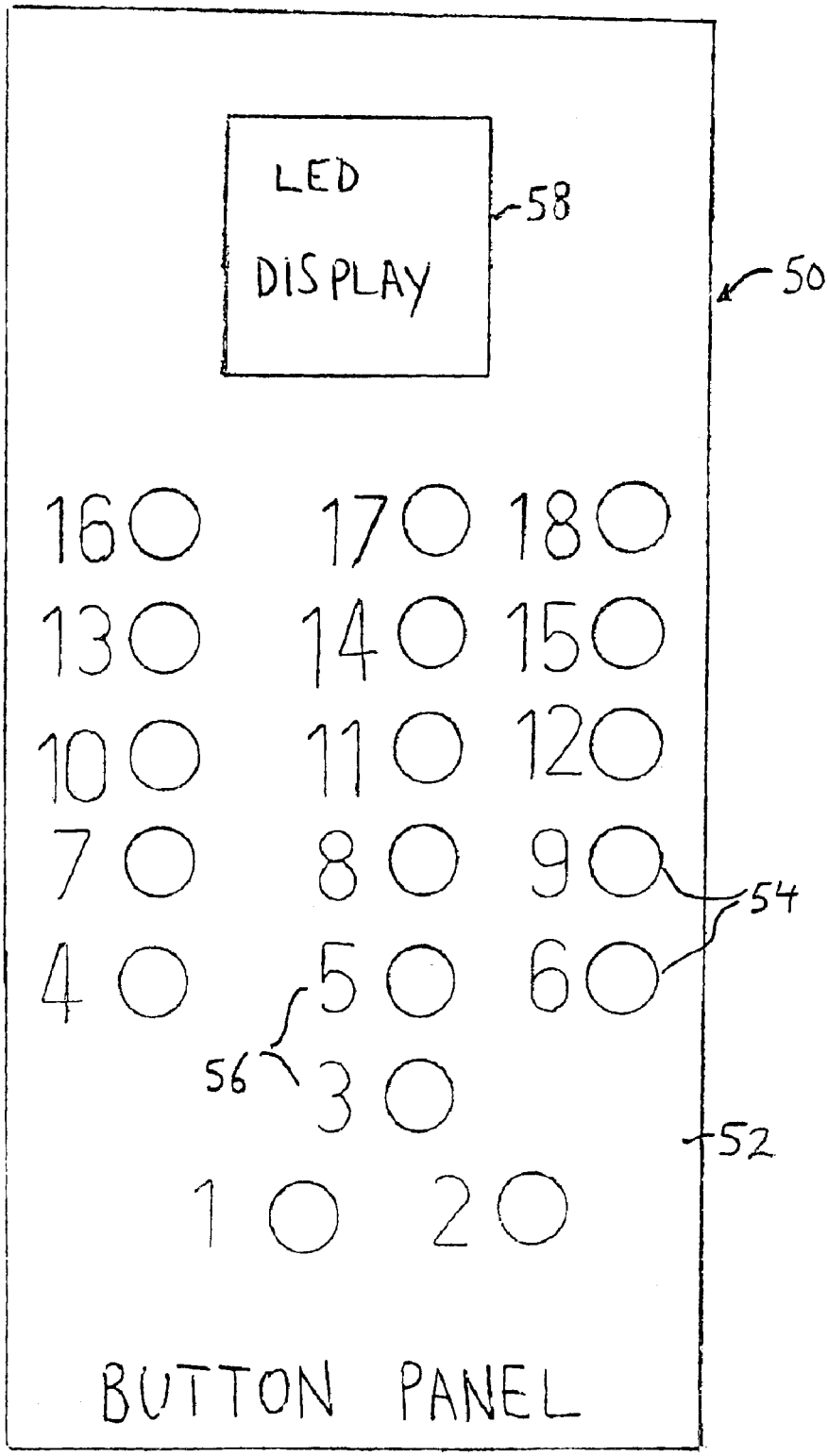
FIG. 6 is a front elevational view a button panel according to the present invention.
Figure 7:
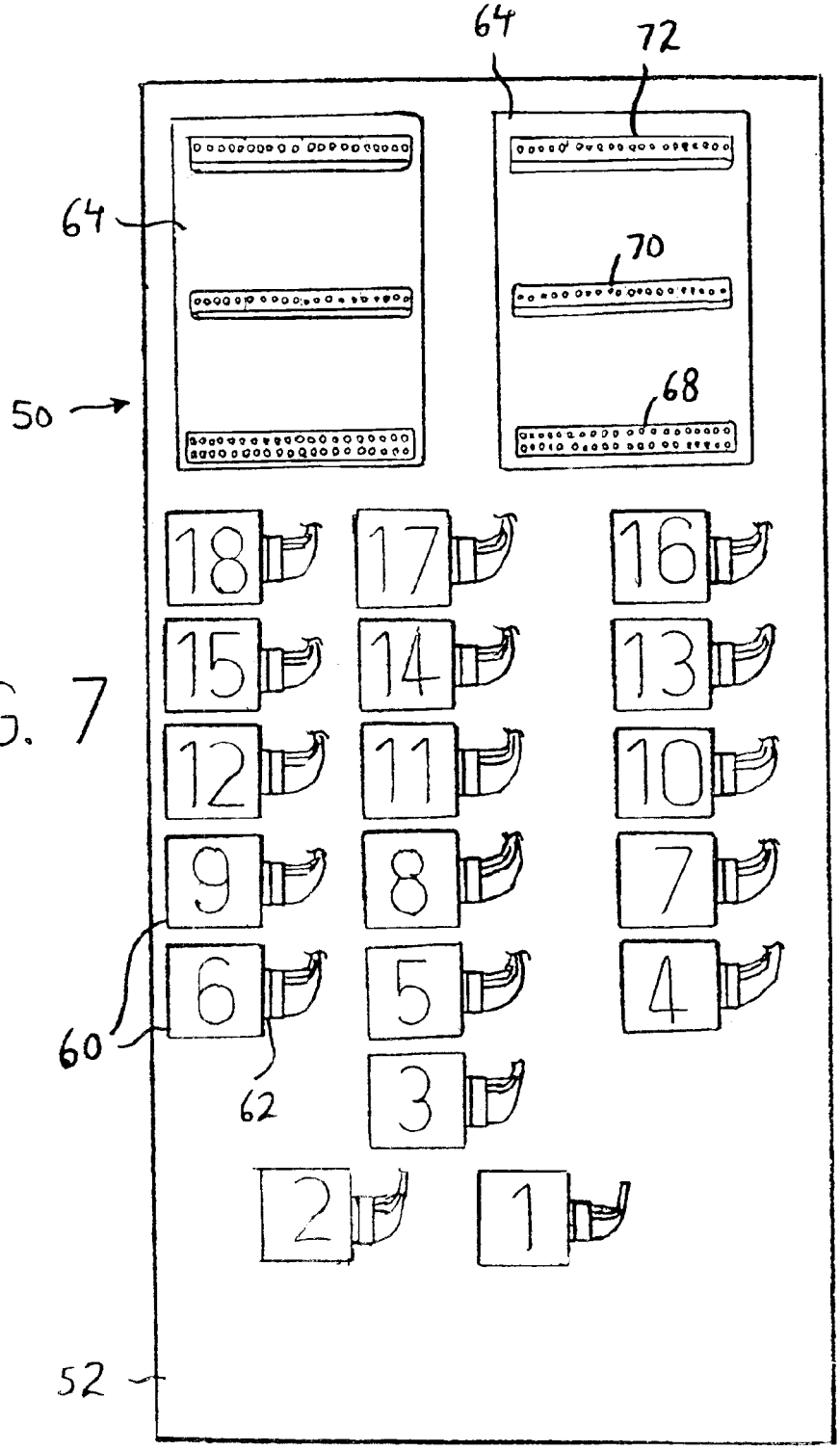
FIG. 7 is a rear elevational view of the button panel of FIG. 6.

Specifically, a button panel 50 according to one embodiment of the present invention is shown in FIGS. 6 and 7 to include a face plate 52 having a plurality of buttons 54 thereon, each having numeric indicia 56 adjacent or on the respective buttons 54. A light emitting diode (LED) display 58 is also provided at the front surface of face plate 52 to indicate the floor at which the elevator is presently located. Actuation portions 60 of buttons 54 are provided on the rear surface of face plate 52, each having a normally open switch (not shown) and including an 8-pin male connector 62 for supplying an output signal from the switch which is closed when a button 54 is depressed. The actual construction of the buttons 54 and actuation portions 60 is omitted since this is not part of the present invention and is well known to those skilled in the art.

In accordance with the present invention, at least one interface board 64 is mounted to the rear surface of face plate 52. Two interface boards 64 are shown in FIG. 7, but the present invention is not limited to this number. Further, although the position of the interface boards 64 is shown spaced away from actuation portions 60, they may be positioned above actuation portions 60, or at any other suitable position.

Figure 8:
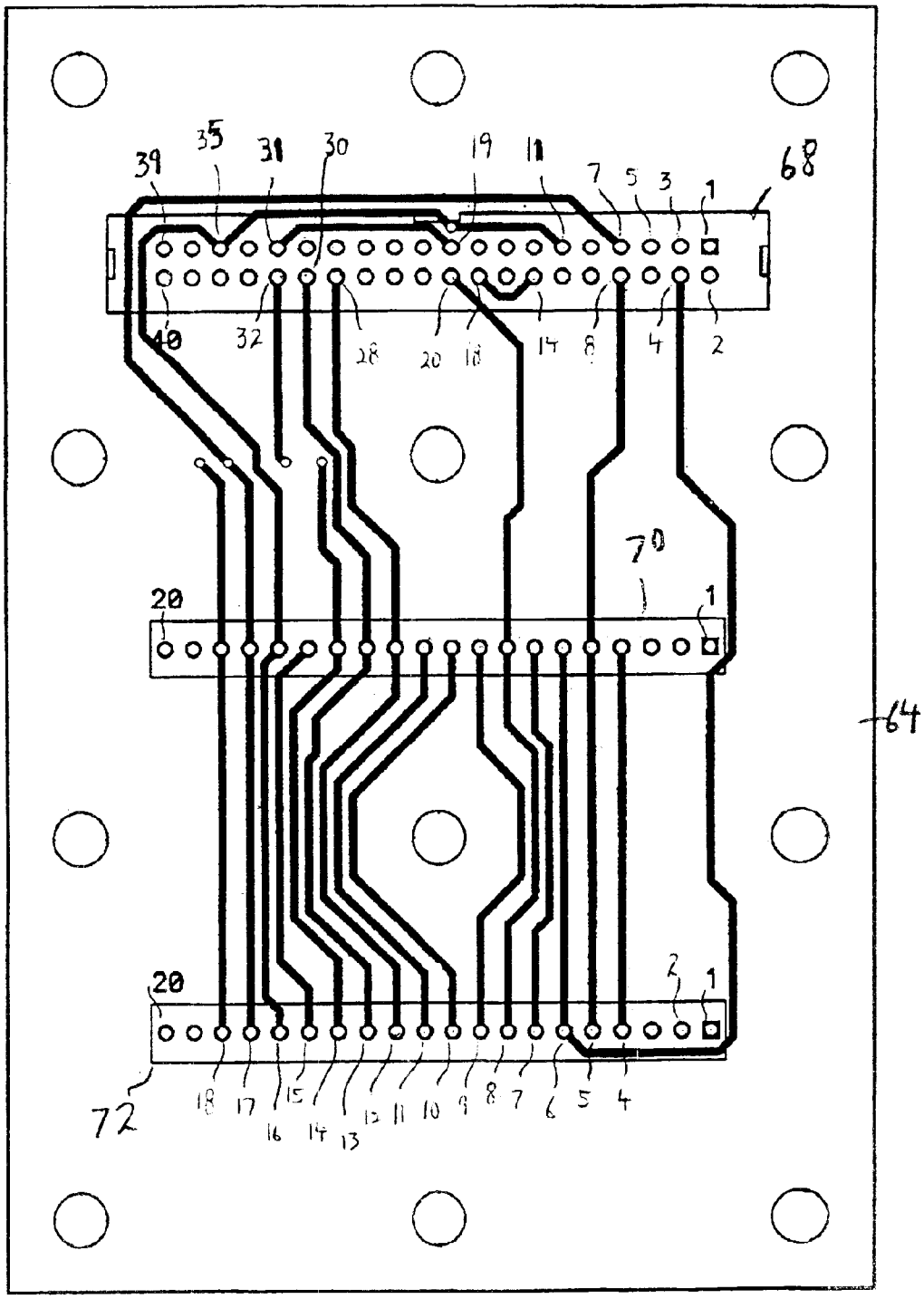
FIG. 8 is a top plan view of one interface board of the button panel of FIG. 6, with the upper layer of circuit wiring connections superimposed thereon.
Figure 9:
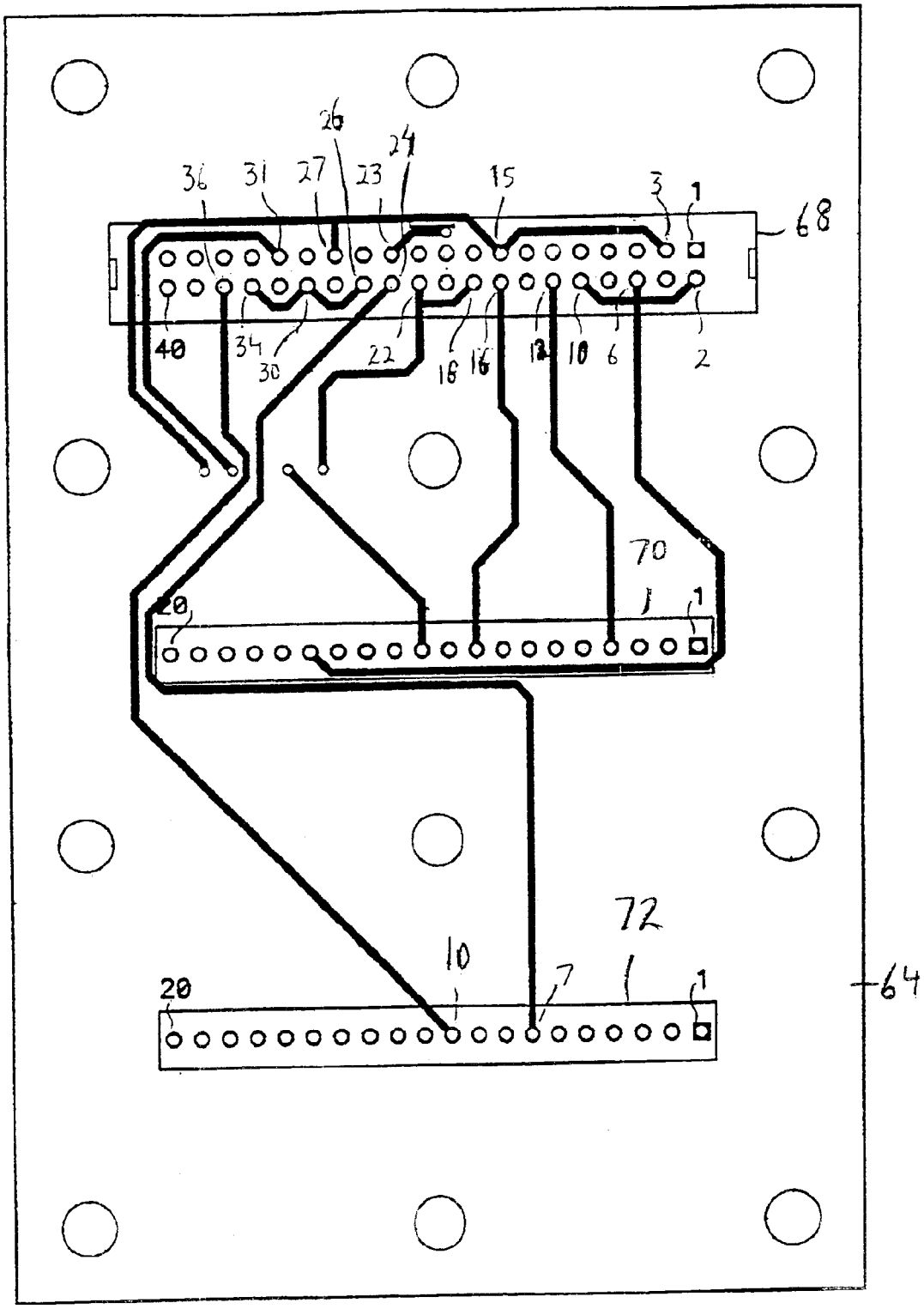
FIG. 9 is a top plan view of one interface board of the button panel of FIG. 6, with the lower layer of circuit wiring connections superimposed thereon.
Figure 10:
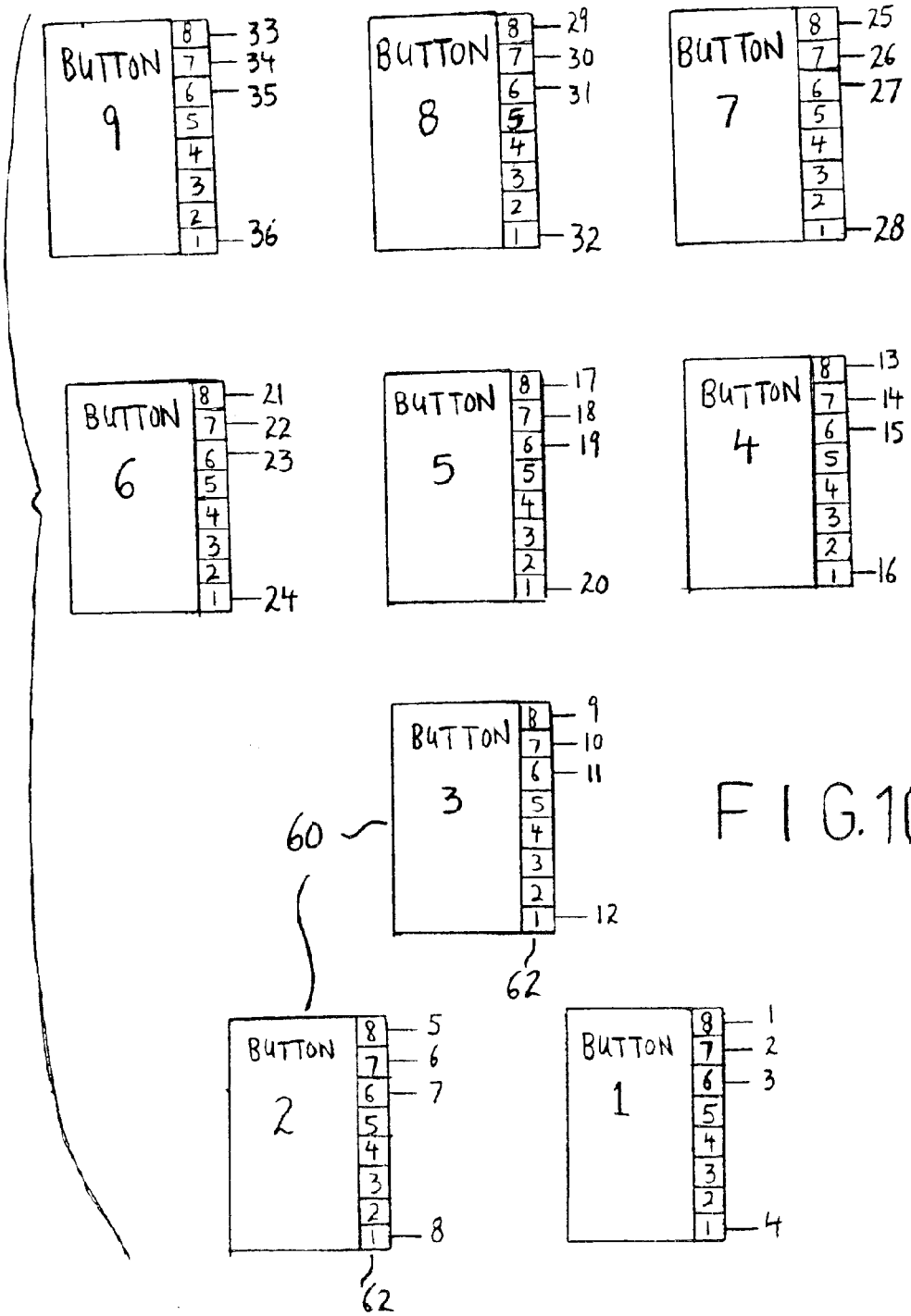
FIG. 10 is a plan view of the first nine buttons of the button panel of FIG. 6 and their connections to the interface board of FIG. 8.
Figure 11:
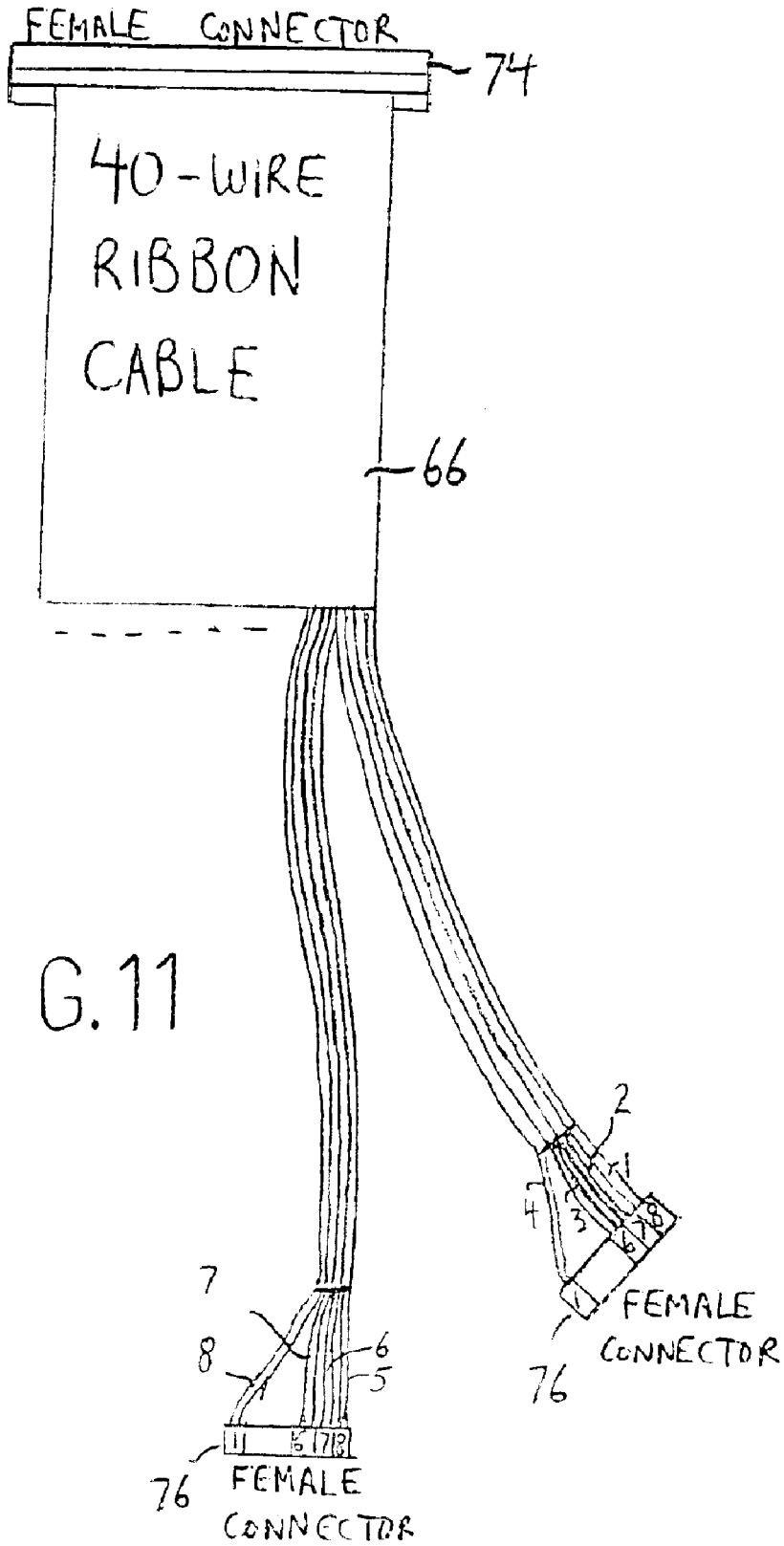
FIG. 11 is a plan view of the cable for providing the connections shown in FIG. 10.

A 40-wire ribbon cable 66 (FIG. 11) provides the electrical connection between 8-pin male connectors 62 and interface boards 64. Specifically, each interface board includes a 40-pin male connector 68 and two 20-pin male connectors 70 and 72, as shown in FIGS. 8 and 9, and 40-wire ribbon cable 66 includes a 40-pin female connector 74 at one end which is connected to 40-pin male connector 68. The opposite end of 40-wire ribbon cable 66 is separated into nine 4-wire sets, each connected to a four contacts of an 8-pin female connector 76 that is connected to respective 8-pin male connectors 62. In effect, the 8-pin female connector has only four active pins and is equivalent to a 4-pin female connector. In the embodiment shown, actuation portions 60 are those sold under the designation LM105-BRL. In this regard, the four contacts are the first, sixth, seventh and eighth contacts of each 8-pin female connector 76.

40-pin male connector 68 is electrically connected through wiring on interface board 64 to 20-pin male connector 70 and to 20-pin male connector 72, either of which is used to output the signals from actuation portions 60 to COP interface board 26. 20-pin male connector 70 functions as an auxiliary input. For example, 20-pin male connector 70 can be used with a second button panel in the same elevator.

Specifically, this connection is made by the circuit wiring on interface board 64 in accordance with the following chart:

| Voltage | 20-pin male connector 72 | 40-pin male connector 68 |
|---|---|---|
| 30 V DC | 1 | 1,5,9,13,17,21,25,29,33 |
| | 2 | |
| | 3 | |
| | 4 | 12 |
| | 5 | 8 |
| | 6 | 4 |
| | 7 | 24 |
| | 8 | 20 |
| | 9 | 16 |
| | 10 | 36 |
| | 11 | 32 |
| | 12 | 28 |
| | 13 | 26,30,34 |
| | 14 | 14,18,22 |
| | 15 | 2,6,10 |
| | 16 | 11,23,35 |
| | 17 | 7,19,31 |
| | 18 | 3,15,27 |
| GROUND | 19 | |
| | 20 | |

It will be appreciated that although the voltage supply of 30 V DC is ganged with all 4-wire sets, the GROUND is independently connected for each 4-wire set.

Thus, interface board 64 transforms the signals of the thirty-six pins from each set of nine buttons 54, that is from the nine 8-pin male connectors 62 associated with each set of nine buttons to signals which can be output from 20-pin male connector 72, thereby providing the equivalent of the outputs from the prior art 20-pin male connectors 20. This is accomplished by ganging certain ones of the pins, for example, pin numbers 26, 30 and 34 of 40-pin male connector 68. In this manner, only COP panel 12 and nine-button boards 14 of the prior art need be changed, without providing any change to the remainder of the system, at a tremendous cost and time saving. Thus, the button/switch arrangement of an Otis Model 401 elevator can be easily updated and/or modified.

In the embodiment shown, there are eighteen buttons 54. Thus, there are two interface boards 64. In this regard, one 40-wire ribbon cable (not shown) connects the two 20-pin male connectors 72 of the two interface boards 64 to one of the 40-pin male connectors 28, 30 and 32 of COP interface board 26.

In operation, when a button 54 is pressed, a momentary contact switch is closed in the respective actuation portion 60, so that the 30V DC signal is supplied to 40-pin male connector 68 from the respective 8-pin male connector 62. At the same time, the 30 V DC signal is used to actuate LED display 58 to display the floor that was selected. Alternatively, individual LEDs can be provided adjacent each button as in the prior art. The signal is then sent to the respective pins of 20-pin male connector 72 in accordance with the above chart, and then output through COP interface board 26 to COP II board 42 which latches the signal, and also sends a signal to the motor control in accordance with the floor number selected.

It will be appreciated that various modifications within the scope of the claims can be made to the present invention. For example, although the present invention has been discussed in relation to a nine button arrangement, with a 4-pin equivalent active female connector associated with each button, that is, M×N pins where M equals nine and N equals four, the present invention is not limited thereto.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A button/switch arrangement for an elevator control, comprising:

a face plate;

a plurality of M buttons mounted to the face plate, where M is an integer greater than one;

a button actuation portion associated with each button such that each button actuation portion closes a switch to supply an output signal when a respective associated button is actuated;

an N-pin connector connected with each button actuation portion for receiving the output signal from the respective button actuation portion, each N-pin connector including a plurality of N active pins, where N is an integer greater than one;

an output board arrangement for receiving the output signals from the N-pin connectors and for supplying motor control signals to a motor to control movement of an elevator; and an interface board including:

a T-pin connector connected with the N-pin connectors and having a plurality of T pins, where T is an integer at least equal to M×N, a first P-pin connector having a plurality of P pins, where P is an integer less than M×N, and wiring connected between the T-pin connector and the first P-pin connector for reducing the number of output signals from said M×N active pins to a maximum of P output signals for supply to said output board arrangement from said first P-pin connector to control movement of the elevator corresponding to each button that is activated.

2. A button/switch arrangement according to claim 1, wherein M equals nine, N equals four, T equals forty and P equals twenty.

3. A button/switch arrangement according to claim 1, wherein said interface board further includes a second P-pin connector connected with said T-pin connector.

4. A button/switch arrangement according to claim 1, wherein said wiring gangs certain ones of the pins of the T-pin connector together to a common pin of the first P-pin connector.

5. A button/switch arrangement according to claim 1, wherein said T-pin connector includes a 40-pin connector and said first P-pin connector includes a 20-pin connector.

6. A button/switch arrangement according to claim 1, wherein the interface board is mounted on the face plate.

7. A button/switch arrangement according to claim 1, wherein one pin of each N-pin connector is connected with respective voltage pins of said T-pin connector, with said voltage pins being ganged together.

8. A button/switch arrangement according to claim 1, wherein one pin each N-pin connector is connected with ground.

9. A button/switch arrangement according to claim 1, wherein said output board arrangement includes a car operating panel for an elevator.

* * * * *